US005354148A

United States Patent [19]

Reymonet

[11] Patent Number: 5,354,148

[45] Date of Patent: Oct. 11, 1994

[54] APPARATUS FOR SPREADING A BONDING EMULSION, OR SIMILAR FLUIDS, AND ROAD-BUILDING MACHINE

[75] Inventor: Jean-Pierre Reymonet, Le Chesnay, France

[73] Assignee: Colas, Boulogne Billancourt Cedex, France

[21] Appl. No.: 953,797

[22] Filed: Sep. 30, 1992

[30] Foreign Application Priority Data

Oct. 1, 1991 [FR] France ..... 91 12068

[51] Int. Cl.[5] ..... E01C 23/07

[52] U.S. Cl. ..... 404/102; 404/106; 404/119

[58] Field of Search ..... 404/101, 102, 106, 118, 404/119

[56] References Cited

U.S. PATENT DOCUMENTS

| | | | |
|---|---|---|---|
| 3,155,021 | 11/1964 | Saur et al. | 404/118 |
| 3,992,124 | 11/1976 | Schrader | 404/118 |
| 4,129,399 | 12/1978 | Ruge | 404/118 |
| 4,678,365 | 7/1987 | Ban et al. | 404/101 X |
| 4,749,304 | 7/1988 | Craig | 404/101 |
| 4,969,773 | 11/1990 | Heims | 404/118 |
| 5,085,537 | 2/1992 | Laditka | 404/101 X |
| 5,120,155 | 6/1992 | Sampson | 404/101 X |
| 5,125,764 | 6/1992 | Veath, Sr. | 404/101 X |

FOREIGN PATENT DOCUMENTS

| | | | |
|---|---|---|---|
| 0292337 | 11/1988 | European Pat. Off. . | |
| 325535 | 7/1989 | European Pat. Off. | 404/101 |
| 0418105 | 3/1991 | . | |
| 0458667 | 11/1991 | European Pat. Off. . | |
| 1577825 | 1/1970 | Fed. Rep. of Germany . | |
| 2204206 | 8/1973 | Fed. Rep. of Germany . | |
| 3534295 | 4/1987 | Fed. Rep. of Germany | 404/101 |
| 3838157 | 5/1990 | Fed. Rep. of Germany | 404/101 |
| 2659993 | 9/1991 | France | 404/101 |
| 2677383 | 12/1992 | France . | |
| 479 | 1/1993 | PCT Int'l Appl. | 404/101 |
| 1715930 | 2/1992 | U.S.S.R. | 404/101 |
| 1041511 | 9/1966 | United Kingdom . | |

*Primary Examiner*—Mark Rosenbaum
*Assistant Examiner*—Frances Han
*Attorney, Agent, or Firm*—Sandler Greenblum & Bernstein

[57] ABSTRACT

Apparatus for spreading a bonding emulsion for road asphalt, a bituminous fluid substance or a similar fluid substance onto the surface of a road, comprising on a moving machine spreading booms associated with ejection nozzles as well as feed circuits for the nozzles, the booms being capable of moving transversely relative to the direction of movement of the moving machine, and being associated with motor mechanisms to drive them during spreading in a to-and-fro movement. The nozzles thereby perform continuous complementary dynamic spreading on the road surface, with the to-and-fro distance of travel of some of the booms being adjustable as a function of the road width over which spreading is required.

21 Claims, 3 Drawing Sheets

APPARATUS FOR SPREADING A BONDING EMULSION, OR SIMILAR FLUIDS, AND ROAD-BUILDING MACHINE

BACKGROUND OF THE INVENTION

1. Field of the Invention

The present invention relates to an apparatus for spreading a bonding emulsion for road asphalt, a bituminous fluid substance or a similar fluid substance onto the surface of a road and to a road-building machine, especially of the finisher type, comprising such an apparatus.

2. Description of the Prior Art

The Applicant has already proposed in patent application FR-90.06306, filed May 21, 1990, for a "Apparatus for spreading a fluid material or similar material, especially a bonding emulsion for road asphalt, onto the surface of a road and road-building machine, especially of the finisher type, comprising such an apparatus", compact apparatus for spreading bonding emulsion capable of being placed at the rear of a finisher, at the rear of the crawler tracks of the latter, between the crawler tracks and the means for spreading the road asphalt onto the road. These spreading appliances mainly comprise three spreading booms of which one is a central spreading boom and two lateral spreading booms, and which during spreading move to-and-fro transversally relative to the direction of movement of the finisher. As a result of this to-and-fro movement, the jets of emulsion issuing from the nozzles of the booms each sweep a portion of the road width. The central boom sprays the portion of road corresponding to the width of the finisher, the distance of travel of the side booms being adjustable according to the total width to be covered. One of the main advantages of such an apparatus compared with background art appliances is that it allows high rates of output at the ejection nozzles, thereby removing the risk of nozzles becoming clogged up as is the case with static spreading boom apparatus.

SUMMARY OF THE INVENTION

The object of the present invention is an improvement to the dynamic spreading boom apparatus defined in above-mentioned application FR-90.06306. A further object is to further reduce the overall dimensions of these appliances on the finishers.

These objects are achieved with a new spreading structure, which allows only two spreading booms to carry out continuous spreading over an adjustable road width, said structure capable of being stored after use within the width of the finisher in such a way so as to avoid clearance problems during transportation.

The present invention therefore concerns an apparatus for spreading a bonding emulsion for road asphalt, a bituminous fluid substance or similar fluid substance, comprising, on a moving machine, spreading booms associated with ejection nozzles as well as feed circuits for the nozzles, the booms being capable of moving transversally relative to the direction of movement of the moving machine and being associated with motor means to drive them during spreading in a to-and-fro movement, the nozzles thus performing continuous complementary dynamic spreading on the road surface, the to-and-fro distance of travel of some of the booms being adjustable as a function of the road width over which spreading is required.

The apparatus comprises comprises two spreading booms whose distances of travel are adjustable as a function of the road width over which spreading is required to allow the two booms to effect spreading together over all the width.

In a preferred embodiment of the invention, the range of to-and-fro movement of the two booms is substantially independent of the road width over which spraying is required, the apparatus comprising means for adjusting the points of departure of the distance of travel of the booms on the moving machine.

Advantageously, this apparatus comprises means for controlling the opening and closing of the objection nozzles so that no overlapping occurs on the spreading performed by the two booms.

In another embodiment, this apparatus can comprise, for each boom, means for controlling, according to the direction of movement in which the boom is moving, the opening and closing of the nozzles of the boom when they cross a particular point referred to as the changeover point, fixed relative to the moving machine, said changeover point being substantially the same for each of the two booms, the booms carrying out spreading respectively, one on one side and the other on the other side of the changeover point.

Advantageously, the motor means that drive a boom are hydraulic jacks whose position relative to the width of the moving machine is adjustable.

In another embodiment, this apparatus comprises rack type means which allow the point of departure of the distance of travel of a spreading boom to be adjusted relative to the width of the moving machine.

Advantageously, the rack type means allow the booms and the hydraulic jacks that control them to be moved.

In another likewise advantageous embodiment, a boom can comprise four nozzles separated from each other by approximately 625 mm.

In another advantageous embodiment, the distance of travel of a boom is approximately 625 mm.

Another object of the invention is a road-building machine, comprising, on a chassis mounted on means of motion, means for spreading road asphalt and means for feeding the spreading means, said machine also comprising an apparatus for spreading a bonding emulsion onto the surface of a road.

The following description of a particular embodiment of the invention is purely illustrative and nonlimiting. It must be read in conjunction with the accompanying drawings.

DESCRIPTION OF THE PREFERRED EMBODIMENTS

Figure 1:
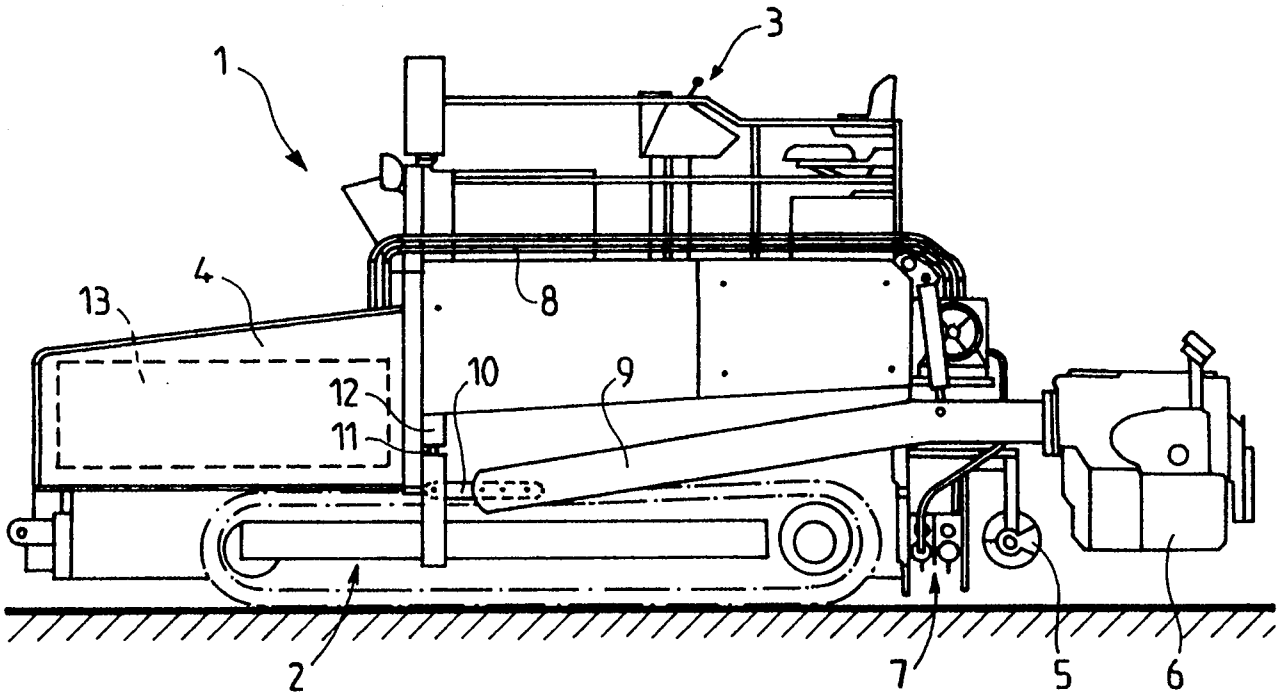
FIG. 1 is a side view of a machine of the finisher type according to the invention, that is to say equipped with spreading apparatus according to one embodiment of the invention.

Referring more particularly to FIG. 1, it can be seen that a machine of the finisher type according to the invention, designated as a whole by 1, is mounted on crawler tracks 2 and comprises essentially a control cab 3, a hopper 4 for receiving road asphalt, hopper 4 being arranged at the front of the finisher, conventional means 5 for spreading road asphalt, consisting particularly of a distribution screw, and which are arranged at the rear of the finisher 1, a table 6 for smoothing the deposited road asphalt layers, and an apparatus 7 for spreading a binder emulsion, associated with an emulsion feed circuit designated as a whole by 8.

The hot road asphalt is transferred from hopper 4 to the road asphalt spreading means 5 in a conventional way by means of a transfer conveyor (not shown) arranged on the finisher 1 between the cab 3 and the part of the finisher 1 which carries the crawler tracks 2. This conveyor is raised slightly in its rear part above the spreading means 7. The smoothing table 6 is mounted at the rear of the finisher 1, beyond the road asphalt spreading means 5, on two bent arms 9 extending on each side of the vehicle substantially from the middle part of the crawler tracks to beyond the spreading means 5. These two arms 9 are articulated, at their end opposite the smoothing table 2, on spacers 10 mounted in the region of the crawler tracks 2, the inclination of the arms 9 relative to the plane of the ground determining the height of the smoothing table 6 and being adjusted by means of hydraulic jacks 11, each extending between a fastening point on the spacer 10 and a fastening point 12 on the side of the tractor chassis in the extension of the floor of the cab 3 at the rear of the latter.

The feed circuit 8 comprises essentially an emulsion reservoir 13 of a capacity greater than 2500 liters. This reservoir 13 is arranged in the sides of hopper 4, in the manner proposed in Applicant's patent application No. FR-91.06758, filed Jun. 4, 1991 for "Finisher type road-building machine, and which published as French Published Application No. 2,677,383".

Referring more particularly to FIGS. 2*a*, 2*b* and 3*a*, 3*b*, it can be seen that the spreading apparatus 7 mainly comprises two spreading booms 14 and 15 mounted in a housing 16 at the rear of the finisher 1. These two booms 14 and 15 extend in parallel fashion across two offset widths of the finisher 1, boom 15 being further away from the rear of the finisher chassis than boom 14. Each of these two booms 14 and 15 is also associated with means 19, 20 for moving each within a lateral to-and-fro movement relative to the direction of movement of the vehicle. These means 19, 20 are, for example, made up of hydraulic jacks whose piston rods 19*a*, 20*a* are joined in the region of their free ends to one end of the corresponding spreading boom 14, 15. These hydraulic jacks 19, 20 are arranged respectively on either side of the housing 16. The distance of travel of piston rods 19*a*, 20*a* of the hydraulic jacks is, for example, 625 mm.

For those skilled in the art, the two booms 14 and 15 are constructed in a conventional way and each is fitted with four nozzles designated respectively, from the end of their boom on which the piston rod of the corresponding hydraulic jack is joined, to the free end of the same boom, by 17*a* to 17*d* and 18*a* to 18*d*. Nozzles 17*a* to 17*d* or 18*a* to 18*d* of the same boom are regularly distributed over the boom and spaced 625 mm apart. The position of the drive means 19, 20 relative to housing 16 and to the width of the finisher is adjustable. An assembly of hydraulic jacks 19, 20 is, for example, rigidly joined for this purpose to a rack C designed to be driven, for example, by one or more cog wheels R mounted on the finisher chassis. Thus the positioning of hydraulic jacks 19, 20 in the width of the finisher will be different according to the spreading width required. This is shown for the purposes of an example respectively in FIGS. 2*a*, 2*b* and 3*a*, 3*b*.

Figure 2A:
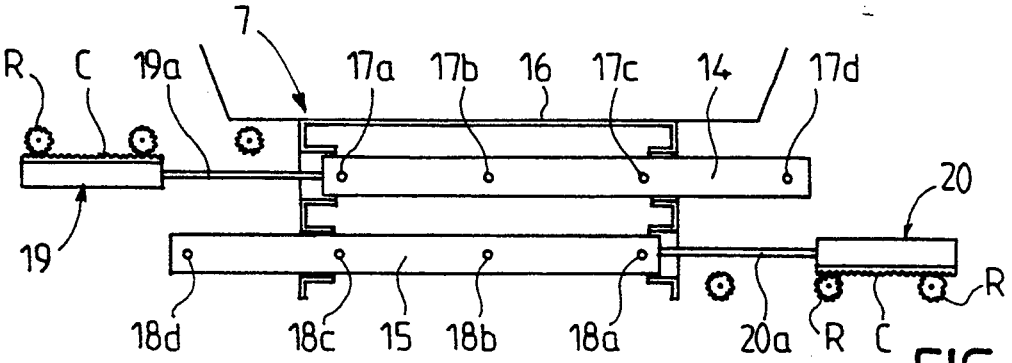
FIGS. 2*a* and 2*b* are diagrammatic views from above showing a spreading apparatus according to a particular embodiment of the invention, and in which the spreading booms are shown in these two figures in two different positions of a to-and-fro cycle allowing them to perform spreading over a first road width.
Figure 2B:
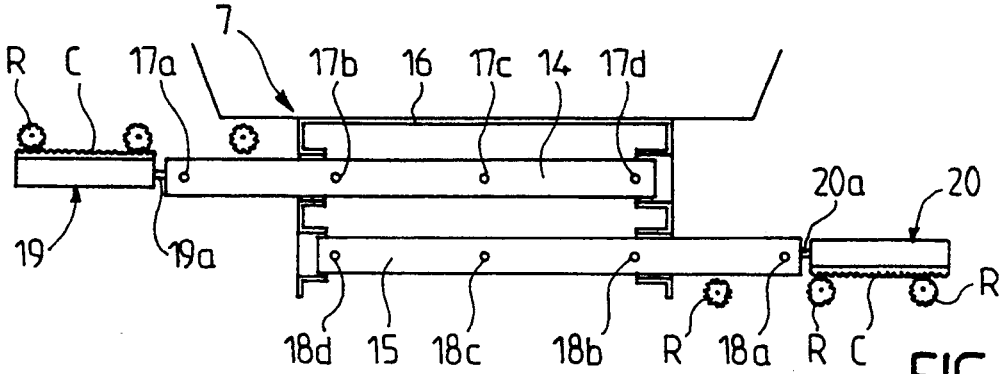

According to the embodiment shown in FIGS. 2*a* and 2*b*, hydraulic jacks 19 and 20 have been adjusted relative to the finisher in such a way that in the retracted position of the hydraulic jacks 19 and 20 (FIG. 2*b*), the end of boom 14, in the region where the boom is rigidly joined to piston rod 19*a*, is 625 mm from the free end of boom 15. Nozzles 17*b*, 17*c* and 17*d* are therefore facing nozzles 18*d*, 18*c* and 18*b* respectively. When hydraulic jacks 19 and 20 are deployed (FIG. 2*a*), end nozzles 17*d* and 18*d* face, respectively, the ends of the body of hydraulic jack 20, 19 from where piston rod 20*a*, 19*a* extend. Nozzles 17*a*, 17*B*, 17*c* are facing nozzles 18*c*, 18*b*, 18*a*, respectively. The total spreading width will therefore only be 2.50 meters (width of a boom 4 distance of travel of the hydraulic jack).

Figure 3A:
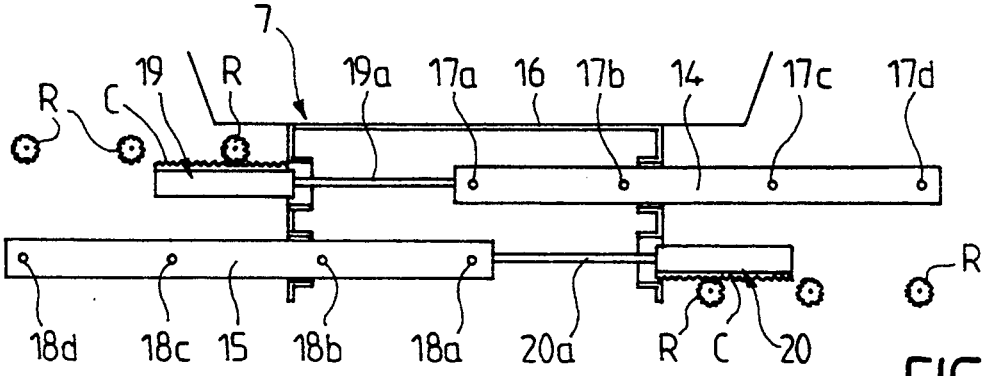
FIGS. 3*a* and 3*b* are views from above similar to FIGS. 2*a* and 2*b*, in which the spreading booms of the apparatus are shown in two positions of another to-and-fro cycle allowing them to perform spreading over a second road width.
Figure 3B:
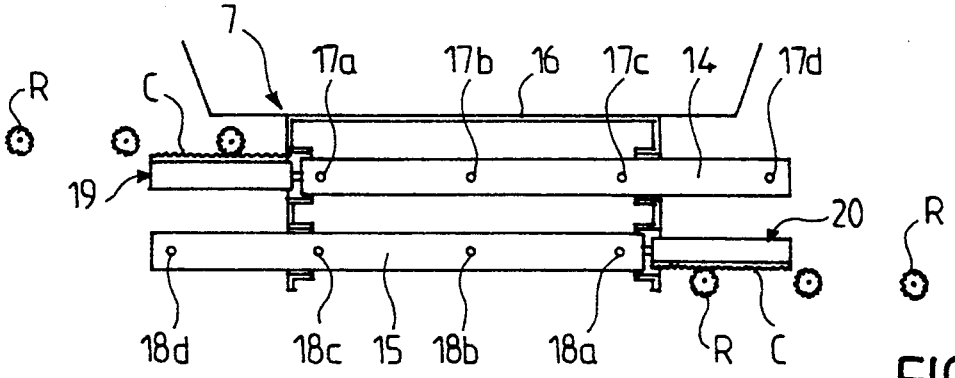

According to the embodiment shown in FIGS. 3*a* and 3*b*, hydraulic jacks 19 and 20 have been brought closer to the housing on which booms 14 and 15 are mounted. When these hydraulic jack 19 and 20 are in the retracted position (FIG. 3*b*), nozzles 18*a*, 18*b*, 18*c* face nozzles 17*c*, 17*b*, 17*a*, respectively. End nozzle 17*d*, 18*d* faces the bodies of the hydraulic jacks. In the deployed position of the hydraulic jacks (FIG. 3*a*), with only nozzles 17*a* and 18*a* face each another, the other nozzles of boom 14 extending to face hydraulic jack 20, the other nozzles on boom 15 extending to face hydraulic jack 19. The width achieved by spreading booms 14 and 15 in this configuration is 3.75 m.

It can readily be seen that other spreading widths are also possible up to 5 m, each of the two booms 14 and 15 spreading in this case over a width of 2.50 m, the maximum width over which it can spread.

To ensure that no overlapping occurs on certain zones of the spreading, it is necessary to associate with the spreading nozzles a means of controlling their opening and closing along their to-and-fro distance of travel. As shown in FIGS. 4*a*, 4*b* and 5*a*, 5*b*, a limit D1 or D2 can be fixed on the width of the finishers at the point where the nozzles of booms 14 and 15 open or close, in such a way that boom 14 performs spreading on one side of this limit D1 or D2 and boom 15 performs spreading on the other side of the limit D1 or D2.

Figure 4A:
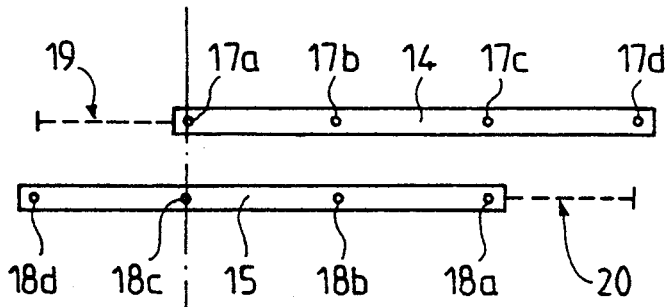
FIGS. 4*a* and 4*b* are diagrammatic representations showing, for these two road widths, a possible opening and closing cycle for the nozzles of the booms of the same apparatus.
Figure 4B:
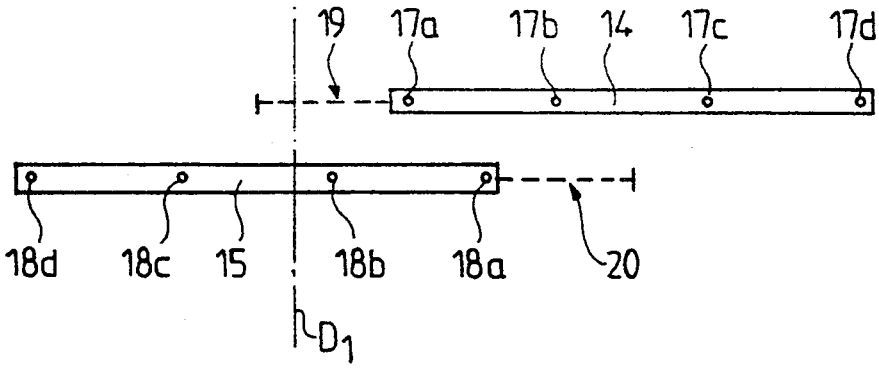

A first example in which D1 is the chosen limit is shown in FIGS. 4*a* and 4*b*. This limit D1 is therefore offset relative to the symmetry axis of the finisher. In FIGS. 4*a* and 4*b* which correspond to the positions of booms 14 and 15 shown in FIGS. 2*a* and 3*a*, the limit D1 will be such that nozzle 18*d* will be open whereas nozzles 18*a*, 18*b*, 18*c* will be closed and nozzles 17*a*, 17*b*, 17*c*, 17*d* will be open for the FIG. 2*a* embodiment, and nozzles 18*d*, 18*c* will be open whereas nozzles 18*a*, 18*b* are closed and nozzles 17*a*, 17*b*, 17*c*, 17 open for the FIG. 3*a* embodiment.

Figure 5A:
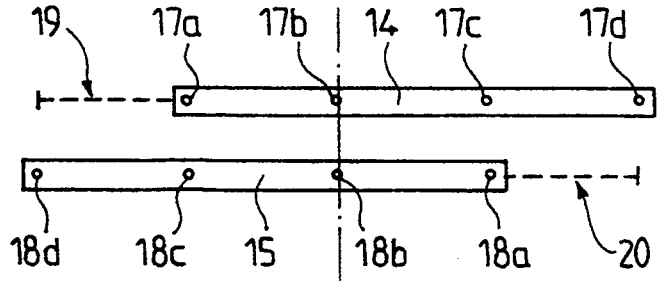
FIGS. 5*a* and 5*b* show an alternate possibility for an opening and closing cycle for the nozzles of the booms for the same road widths.
Figure 5B:
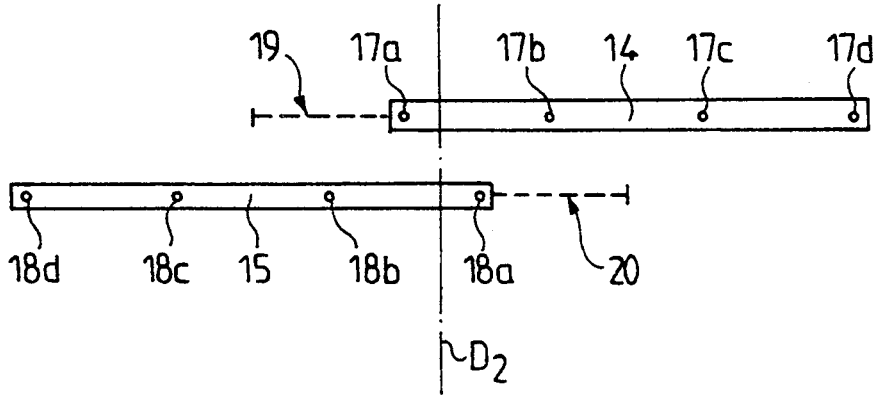

According to the embodiment shown in FIGS. 5*a* and 5*b*, the changeover limit D2 corresponds to the plane of symmetry of the finisher 1. In the first case (FIG. 5*a*), nozzles 17*b*, 17*c*, 17*d* and 18*b*, 18*c*, 18*d* are open whereas nozzles 17*a* and 18*a* are closed. In the second case (FIG. 5*b*), nozzles 17*b*, 17*c*, 17*d* and 18*b*, 18*c*, 18*d* are open whereas nozzles 17*a* and 18*a* are opening.

The means for opening or closing the spreading nozzles can be conventional type servo-valves. They could also be purely mechanical, for example of the type defined in patent application FR-91.10193 filed by the Applicant on Aug. 9, 1991 for a "Mechanically-controlled actuating apparatus for opening and closing a valve controlling an ejection nozzle moving on a support according to a predetermined trajectory, which is a family member of U.S. application Ser. No. 07/925,849".

What is claimed is:

1. Apparatus for spreading a bonding emulsion for road asphalt, a bituminous fluid substance or a similar fluid substance onto the surface of a road, comprising:

a moving machine;

two spreading booms positioned on said moving machine and capable of moving transversely, in a to-and-fro motion, relative to a direction of movement of said moving machine, the to-and-fro motion of said two spreading booms being adjustable as a function of road width over which spreading is to occur to enable said two spreading booms to effect spreading over the entire road width;

a plurality of ejection nozzles on said two spreading booms;

feed circuits for feeding a substance to said plurality of ejection nozzles; and motor elements to transversely drive each of said two spreading booms in the to-and-fro motion, so that said plurality of ejection nozzles are capable of performing continuous dynamic spreading on the road surface.

2. The apparatus according to claim 1, wherein the to-and-fro motion of said two spreading booms includes a range that is substantially independent of the road width over which spraying is to occur, and comprising means for adjusting points of departure of a distance of travel of said two spreading booms on said moving machine.

3. The apparatus according to claim 2, wherein said moving machine has a width, and said means for adjusting points of departure comprise rack elements which allow the points of departure to be adjusted relative to the width of the moving machine.

4. The apparatus according to claim 3, wherein said rack elements allow said two spreading booms and said motor elements to be moved, and said motor elements comprise hydraulic jacks.

5. The apparatus according to claim 3, wherein said rack elements allow said two spreading booms and said motor elements to be moved.

6. The apparatus according to claim 5, wherein said motor elements comprise hydraulic jacks.

7. The apparatus according to claim 1, comprising means for controlling opening and closing of said plurality of said ejection nozzles, so that no overlapping occurs on the spreading performed by said two spreading booms.

8. The apparatus according to claim 7, comprising means for controlling opening and closing of said plurality of ejection nozzles according to direction of movement of each of said two spreading booms when each of said two spreading booms crosses a changeover point, fixed relative to said moving machine

9. The apparatus according to claim 8, wherein said changeover point is substantially the same for each of said two spreading booms, said two spreading booms and said plurality of nozzles being constructed and arranged to permit spreading from one of said two spreading booms on one side of said changeover point and from the other of said two spreading booms on another side of said changeover point.

10. The apparatus according to claim 1, wherein said motor elements comprise hydraulic jacks.

11. The apparatus according to claim 10, wherein said moving machine has a width, and said hydraulic jacks are adjustably positionable relative to the width of said moving machine.

12. The apparatus according to claim 1, wherein each of said two spreading booms comprises four nozzles separated from each other by about 625 mm.

13. The apparatus according to claim 12, wherein each of said two spreading booms has a distance of travel of about 625 mm.

14. Road-building machine, comprising:

a chassis, said chassis being mounted on elements for moving said chassis;

means for spreading road asphalt mounted on said chassis;

means for feeding material to said means for spreading;

two spreading booms spreading a bonding emulsion substance onto the surface of a road associated with said chassis, and capable of moving transversely, in a to-and-fro motion, relative to a direction of movement of said chassis, the to-and-fro motion of said two spreading booms being adjustable as a function of road width over which spreading is to occur to enable said two spreading booms to effect spreading over the entire road width;

a plurality of ejection nozzles on said two spreading booms;

feed circuits for feeding a substance to said plurality of ejection nozzles; and motor elements to transversely drive each of said two spreading booms in the to-and-fro motion, so that said plurality of ejection nozzles are capable of performing continuous dynamic spreading on the road surface.

15. The apparatus according to claim 14, wherein the to-and-fro motion of said two spreading booms includes a range that is substantially independent of the road width over which spraying is to occur, and comprising means for adjusting points of departure of a distance of travel of said two spreading booms.

16. The apparatus according to claim 15, wherein said chassis machine has a width, and said means for adjusting points of departure comprise rack elements which allow the points of departure to be adjusted relative to the width of said chassis.

17. The apparatus according to claim 14, comprising means for controlling opening and closing of said plurality of said ejection nozzles, so that no overlapping occurs on the spreading performed by said two spreading booms.

18. The apparatus according to claim 14, comprising means for controlling opening and closing of said plurality of ejection nozzles according to direction of movement of each of said two spreading booms when each of said two spreading booms crosses a changeover point, fixed relative to said moving machine.

19. The apparatus according to claim 18, wherein said changeover point is substantially the same for each of said two spreading booms, said two spreading booms and said plurality of nozzles being constructed and arranged to permit spreading from one of said two spreading booms on one side of said changeover point and from the other of said two spreading booms on another side of said changeover point.

20. The apparatus according to claim 14, wherein said motor elements comprise hydraulic jacks, said chassis has a width, and said hydraulic jacks are adjustably positionable relative to the width of said chassis.

21. The apparatus according to claim 14, wherein each of said two spreading booms comprises four nozzles separated from each other by about 625 mm, and each of said two spreading booms has a distance of travel of about 625 mm.

* * * * *

UNITED STATES PATENT AND TRADEMARK OFFICE

CERTIFICATE OF CORRECTION

PATENT NO. : 5,354,148
DATED : October 11, 1994
INVENTOR(S) : Jean-Pierre REYMONET It is certified that error appears in the above-indentified patent and that said Letters Patent is hereby corrected as shown below:

At the cover sheet, section [56], line 3 under Foreign Patent Documents, change "0418105 3/1991" to ---0418105 3/1991 European Pat. Off.---.

At column 6, line 36 (claim 14, line 8), change "booms spreading" to ---booms for spreading---.

Signed and Sealed this

Thirtieth Day of May, 1995

*Attest:*

*Attesting Officer*

BRUCE LEHMAN

*Commissioner of Patents and Trademarks*